United States Patent [19]

Hasara

[11] 4,047,256

[45] Sept. 13, 1977

[54] BRIDGE CONSTRUCTION METHOD

[76] Inventor: Bernard Hasara, P.O. Drawer 2047, Conroe, Tex. 77301

[21] Appl. No.: 740,807

[22] Filed: Nov. 11, 1976

[51] Int. Cl.[2] ..... E01D 1/00

[52] U.S. Cl. ..... 14/1; 52/741; 105/1 A

[58] Field of Search ..... 14/1, 2.4; 52/143, 741, 52/745; 404/1, 72; 105/1 A, 157 R, 182 R

[56] References Cited

U.S. PATENT DOCUMENTS

| | | | |
|---|---|---|---|
| 999,126 | 7/1911 | Sistermann | 14/1 X |
| 1,101,110 | 6/1914 | Wood | 105/1 A |
| 1,593,999 | 7/1926 | Bingham | 14/1 |
| 2,363,767 | 11/1944 | Yassin | 14/1 |
| 2,782,733 | 2/1957 | Ewing | 14/1 X |
| 3,435,909 | 4/1969 | Wenger | 52/143 X |
| 3,834,111 | 9/1974 | Acker | 52/143 X |
| 3,925,840 | 12/1975 | Wagner | 14/1 |

FOREIGN PATENT DOCUMENTS

| | | | |
|---|---|---|---|
| 1,123,356 | 2/1962 | Germany | 14/1 |
| 935,911 | 12/1955 | Germany | 14/1 |
| 698,133 | 11/1965 | Italy | 14/1 |

*Primary Examiner*—Nile C. Byers
*Attorney, Agent, or Firm*—Browning, Bushman & Zamecki

[57] ABSTRACT

A bridge construction method comprising removing the trucks and wheels from a flatbed type railroad car to provide a bridge substructure, preparing support means upstanding from an area to be bridged for emplacement of the substructure, and emplacing the substructure on the support means over the area.

17 Claims, 7 Drawing Figures

BRIDGE CONSTRUCTION METHOD

BACKGROUND OF THE INVENTION

1. Field of the Invention

The present invention pertains to bridge construction and especially to the quick, easy and economical construction of bridges over culverts, ditches and other depressions. The method of the invention may also be adapted to the construction of elevated bridges. In particular, the invention provides for the construction of such bridges where in the major substructural components of the bridges are used pre-fabricated parts which would otherwise be scrapped.

2 Description of the Prior Art

While conventional methods of bridge construction are too numerous to be described in detail here, it can be appreciated that they all have certain features in common. In particular, in any conventional bridge construction method, the bridge, including not only its support means but also its substructure and any other portions, is built from scratch from basic components. Such methods are time consuming and expensive due to the labor required to assemble these basic components. Furthermore, the basic components themselves require substantial amounts of raw materials for their formation and do not make sufficient use of the recycling of used materials.

SUMMARY OF THE INVENTION

The present invention makes use of discarded flatbed type railraod cars such as flatcars and trailer train cars for the main substructural components of bridges. The wheels and trucks are removed from the cars to provide a bridge substructure. Support means are prepared upstanding from the area to be bridged for emplacement of the substructure, and the substructure is then emplaced on the support means over the area.

The cars so used would otherwise be completely wasted, or would, at best, be sold for scrap metal. Thus, to the extent that cars have been re-cycled in the past, the re-cycling process has been expensive and has required the conversion of the cars to a substantially different form. However, it has been discovered that such cars, in virtually their original form are particularly well suited for use as bridge substructures. Thus the present method not only eliminates much of the time and labor required to construct a bridge, but also makes the most economical use of the used cars thereby reducing the demand for raw materials.

In preferred embodiments of the invention, bridge deck structures may be provided and may extend laterally beyond the sides of the substructure. In some installations, a single car may suffice. However, to construct larger bridges, several of the substructures formed from respective cars may be placed side by side and/or end to end. Interconnection of the several substructures is relatively simple, and a common bridge deck structure may be provided and may comprise part of the interconnection means. Thus it can be seen that the method of the invention is highly flexible and adaptable in addition to being economical.

Accordingly, it is a principal object of the present invention to provide an improved method of bridge construction.

Another object of the invention is to provide a bridge construction method in which the major part of the bridge substructure is formed from readily available, used pre-fabricated parts.

Still another object of the invention is to provide a highly flexible and adaptable bridge construction method.

Yet a further object of the invention is to provide a bridge construction method which makes maximum use of re-cycling techniques and minimizes the demand for raw materials.

Still other objects, features, and advantages of the present invention will be made apparent by the following description of the preferred embodiments, the drawings, and the claims.

DESCRIPTION OF THE PREFERRED EMBODIMENTS

Figure 1:
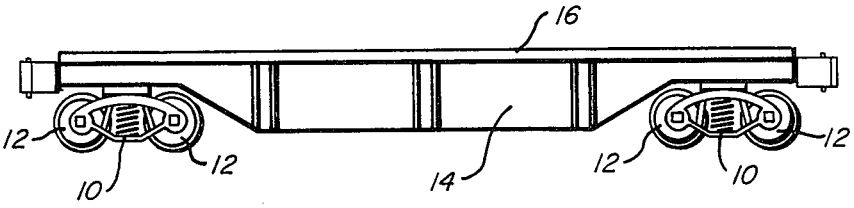
FIG. 1 is a side elevational view of a railroad car as used in the present invention.

Referring now to FIG. 1 there is shown a flatbed type railroad car, in this instance a flatcar. In accord with the method of the present invention, the trucks 10 and wheels 12 of the car are removed whereby the remainder forms a bridge substructure 14. In a flatcar, the deck structure 16, usually of wood, may be left on the car to provide part of the substructure or to form a bridge deck structure, but is preferably also removed. In a trailer train car, the original decking is typically comprised of metal plate and is preferably left in place to serve as or underlie the bridge deck structure. As used herein, the term "bridge deck structure" will refer to the car deck structure, where the later is used as the deck of the finished bridge, or to added deck structure, where such added structure overlies or replaces the original car deck.

Figure 2:
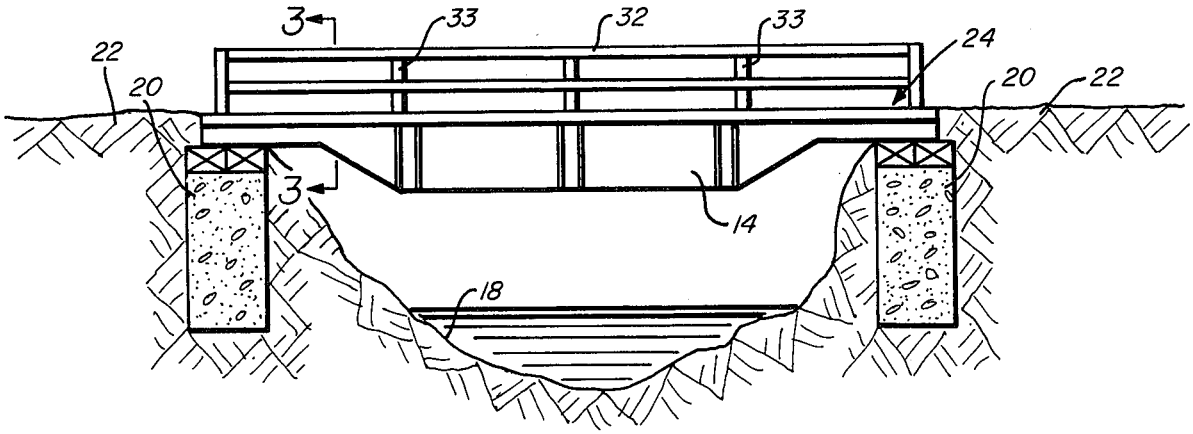
FIG. 2 is a side elevational view of a bridge constructed from a single car.

Referring now to FIG. 2, there is shown a bridge over a ditch or culvert 18 formed from a single one of the substructures 14. Concrete pillars 20 have been formed within the embankments 22 on opposite sides of the ditch 18 to serve as support means. The substructure 14 has been emplaced with each end resting on a respective one of the pillars 20 so that it extends over the ditch 18. The ends of the substructure 14 are then suitably affixed to the pillars 20 by suitable means well known to those skilled in the art.

Figure 3:
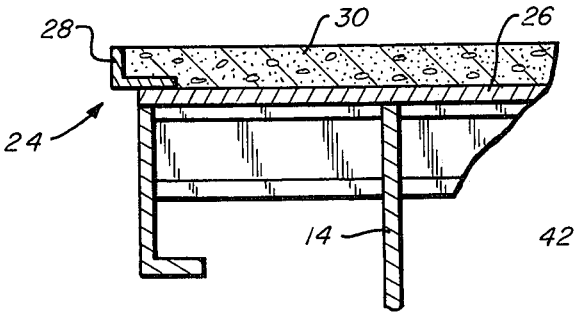
FIG. 3 is a fragmentary sectional view generally on lines 3—3 of FIG. 2 on an enlarged scale.

Either before or after the emplacement of the substructure 14 on the pillars 20, a bridge deck structure 24 is emplaced on the substructure 14. As shown in FIG. 3 a metal plate 26 is welded to or otherwise affixed to the substructure 14. Metal curbs 28, of L-shaped cross section, are then affixed, as by welding, around the edges of the plate 26 with one leg lying on the plate 26 and the other leg upstanding therefrom. Concrete, asphalt, or other suitable road construction material 30 is then poured over the plate 26 between the curbs 28. Guard rails 32 are secured to the side of the bridge deck structure 24 by rigidly connected vertical beams 33 imbedded in the concrete 30, welded to the curbs 28 or attached by any other suitable means.

Although the support means shown are in the form of concrete pillars 20, other means may be used. For example, wood pilings may be driven into the embankments 22 to serve this purpose. In some cases, where the embankments comprise rock or are otherwise sufficiently solid, the preparation of the support means may simply comprise the clearing of a suitable site in each embankment for receipt of a respective end of the substructure 14.

Referring now to FIGS. 4–7, there is shown a second embodiment of the invention in which a bridge has been formed from a plurality of substructures substantially identical to substructure 14 of the first embodiment. Four such substructures are shown and are designated 14*a*, 14*b*, 14*c* and 14*d*. Substructures 14*a* and 14*b* have been placed laterally adjacent each other and joined together by a bridge deck structure 34 and by bracing members to be described more fully below. The bridge deck structure 34 includes portions 34*a* extending laterally beyond the outer sides of the substructures 14*a* and 14*b*, and a portion 34*b* which extends across the space between substructures 14*a* and 14*b*. Portion 34*b* may also be considered to extend laterally beyond the inner or adjacent sides of the substructures 14*a* and 14*b*.

Figure 6:
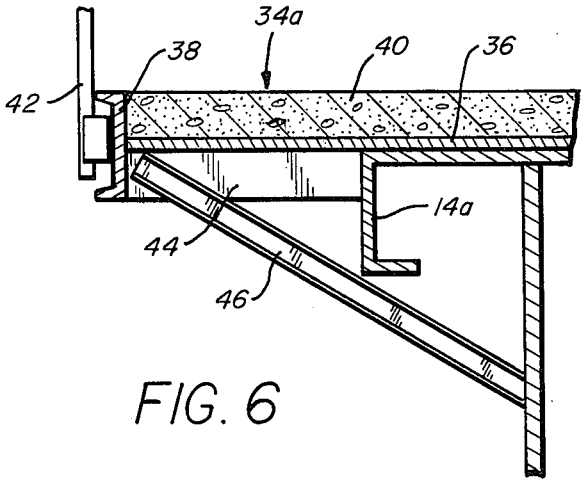
FIG. 6 is a fragmentary sectional view generally on lines 6—6 of FIG. 4 on an enlarged scale.
Figure 7:
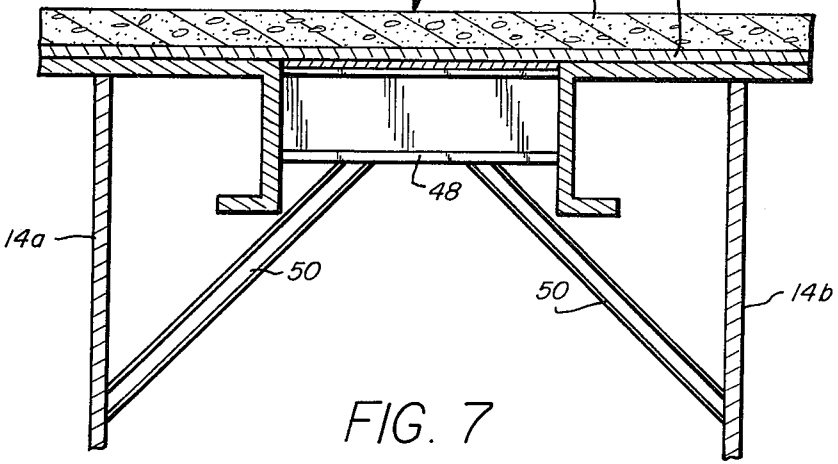
FIG. 7 is a fragmentary sectional view generally on lines 7—7 of FIG. 4 on an enlarged scale.
Figure 4:
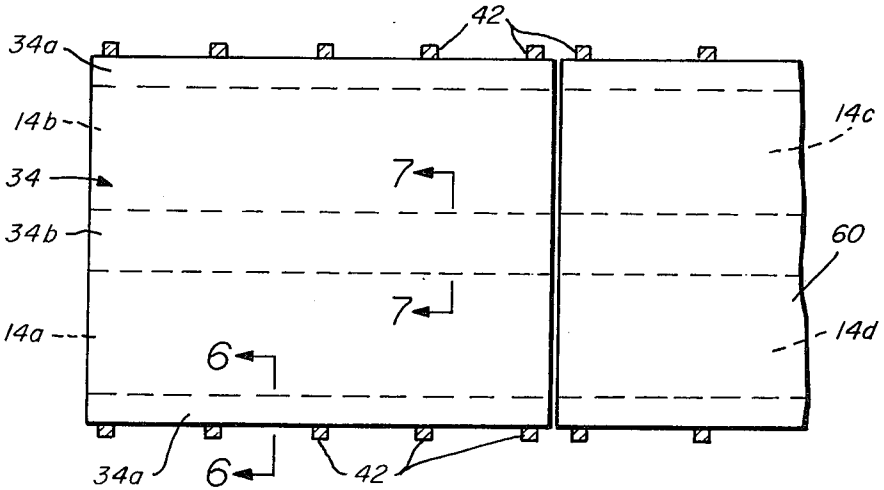
FIG. 4 is a partial top plan view of a bridge constructed from several cars.
Figure 5:
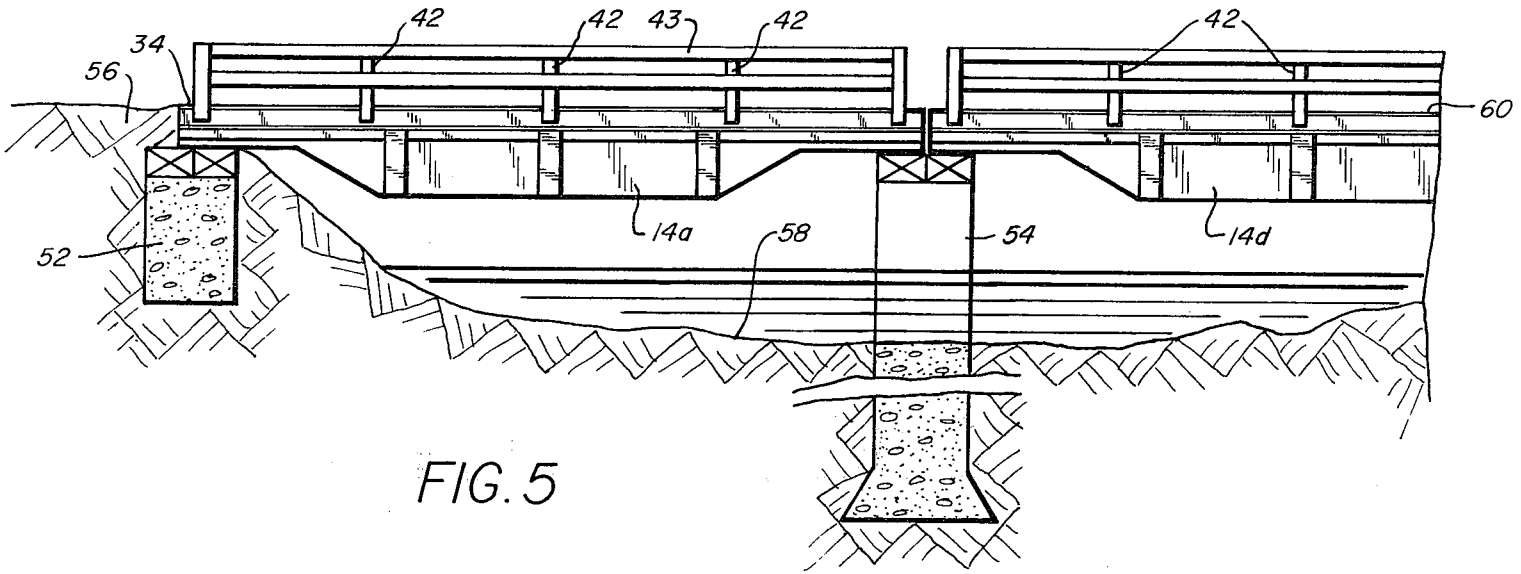
FIG. 5 is a side elevational view of the structure of FIG. 4.

As best seen in FIGS. 6 and 7, the deck structure 34 comprises one or more metal plates, in this case a single plate 36, overlying and affixed to the substructures 14*a* and 14*b*. Beams 38 are welded to the outer edges of the plate 36 so as to extend both upwardly and downwardly therefrom. The upstanding portions of the beams 38 form curbs between which a layer of concrete, asphalt, or the like 40 is poured to overlie the plate 36. The vertical beams 42 rigidly connected to guard rails 43 are welded or otherwise affixed to the outer surfaces of the beams 38.

As shown in FIG. 6, a plurality of bracing members are secured so as to brace and support the portions 34*a* of the bridge deck structure. These comprise horizontal beams 44 extending laterally outwardly from the substructures to the beams 38 along the underside of plate 36, and diagonal struts 46 extending from the sides of the substructures upwardly and laterally outwardly to the outer ends of the beams 44. Each of the beams 44 and struts 46 are welded, bolted or otherwise secured in place.

Similar bracing members are provided to support and brace the portion 34*b* of the bridge deck structure and to cooperate with the bridge deck structure in interconnecting the substructures 14*a* and 14*b*. As shown in FIG. 7, these bracing members include horizontal beams 48 extending between the inner sides of the substructures along the underside of the plate means 36, and diagonal struts 50 each extending from the inner side of one of the substructures 14a or 14b upwardly and inwardly to the beam 48.

Referring again to FIG. 5, a first support means in the form of a concrete pillar 52 has been embedded in the embankment 56 on one side of the ditch 58 to be bridged. Pillar 52 may be wide enough to support an entire end of the bridge, or, several of the pillars 52 may be arranged along the end of the bridge. Another such support means (not shown) is provided on the other side of the ditch 58. A third support means in the form of a concrete pillar 54 has been embedded in the ground at the center of the ditch 58 and extends upwardly therefrom to the same height as pillar 52. Again, one wide pillar or a plurality of pillars may be provided.

The pair of substructures 14*a* and 14*b* with their deck structure 34 and other interconnections may be considered a bridge module. This module is emplaced on the support means with one end on pillar 52 and one end on pillar 54 as shown. Similarly, substructures 14*c* and 14*d* are interconnected by a bridge deck structure 60 and bracing members to form an identical module which is emplaced with one end on pillar 54 and the other end on the support means (not shown) on the opposite side of ditch 58 from pillar 52. The ends of the modules are secured to the support means, and in some cases the adjacent ends of the two modules which rest on pillar 54 may be connected to each other.

It can thus be seen that the above-described method allows for the economical use of used flatbed type railroad cars with minimal disassembly, reformation, etc. while also providing a simple, fast, and economical method of constructing a bridge requiring a minimum amount of raw material. It can also be seen that the method of the invention is highly versatile and, in particular, that many modifications of the two embodiments described above may be made. For example, in the above embodiments, the bridge is constructed at ground level over a depression such as a ditch. However, the method could be used to construct elevated bridges by placing the substructures on elevated support means and providing ramp means connecting the substructures to the ground.

Some bridges may have only a single substructure across their widths, but may be laterally extended at both sides by means such as those shown in FIG. 6. Furthermore, modules comprised of a single substructure may be placed end to end in the same manner as the double substructure modules of FIG. 5 to increase the length of the bridge. On the other hand, a single module of the type of FIGS. 4 and 5 may be used to construct a short but relatively wide bridge. Using the basic principle of the embodiment of FIG. 5 but adding a plurality of longitudinally spaced apart pillars 54, even longer bridges may be constructed by using more than two modules. Modules including two substructures connected side by side may or may not include laterally extending bridge deck portions such as 34a and may or may not be spaced apart and connected by a deck portion such as 34b.

Numerous other modifications will suggest themselves to those skilled in the art. It is thus intended that the scope of the invention be limited only by the claims which follow.

I claim:

1. A bridge construction method comprising: removing the trucks and wheels from a flatbed type railroad car to provide a bridge substructure, preparing support means upstanding from an area to be bridged for emplacement of said substructure, and emplacing said substructure on said support means over said area.

2. The method of claim 1 comprising preparing two such support means on opposite sides of said area and employing said substructure with each end disposed on a respective one of said support means.

3. The method of claim 1 wherein said preparation of said two support means comprises forming pillars on opposite sides of said area.

4. The method of claim 3 wherein said area is a depression and said pillars are positioned within embankments on opposite sides of said depression.

5. The method of claim 1 comprising emplacing a bridge deck structure on said substructure.

6. The method of claim 5 wherein said emplacement of said bridge deck structure is preceded by removing a car deck structure from said car.

7. The method of claim 5 wherein said emplacement of said bridge deck structure comprises overlying said substructure with metal plate means.

8. The method of claim 7 wherein said emplacement of said bridge deck structure further comprises pouring road construction material over said metal plate means.

9. The method of claim 5 wherein said bridge deck structure is emplaced so as to extend laterally beyond the side edges of said substructure.

10. The method of claim 9 comprising securing bracing members between said substructure and the laterally extending part of said bridge deck structure.

11. The method of claim 5 comprising emplacing two such substructure on said support means laterally adjacent each other and emplacing said bridge deck structure to extend across both of said substructures.

12. The method of claim 11 comprising laterally spacing said substructures from each other and emplacing said bridge deck structure to extend across the space between said substructures.

13. The method of claim 12 comprising securing bracing members between said substructures and the part of said bridge deck structure extending across said space.

14. The method of claim 13 including securing first ones of said bracing members between said substructures and securing second ones of said bracing members between said substructures and said first bracing members.

15. The method of claim 5 including the further step of securing guard rails along the sides of said bridge deck structure.

16. The method of claim 1 comprising emplacing two such substructures on said support means longitudinally adjacent each other.

17. The method of claim 16 comprising providing two such support means on opposite sides of said area and a third such support means within said area and emplacing each of said substructures with one end on a respective one of said two support means with the other ends of both of said substructures adjacent each other on said third support means.

* * * * *